United States Patent [19]

Edwards

[11] Patent Number: 4,738,111

[45] Date of Patent: Apr. 19, 1988

[54] POWER UNIT FOR CONVERTING HEAT TO POWER

[76] Inventor: Thomas C. Edwards, 1426 Gleneagles Way, Rockledge, Fla. 32955

[21] Appl. No.: 804,400

[22] Filed: Dec. 4, 1985

[51] Int. Cl.[4] ..... F01K 11/00; F01K 13/00

[52] U.S. Cl. ..... 60/671; 60/669; 290/1 A

[58] Field of Search ..... 60/651, 671, 669, 670; 290/1 A

[56] References Cited

U.S. PATENT DOCUMENTS

| | | | |
|---|---|---|---|
| 1,272,378 | 7/1918 | Collins . | |
| 2,345,950 | 4/1944 | Salzmann . | |
| 2,952,138 | 9/1960 | Russell et al. | 60/671 |
| 3,040,528 | 6/1962 | Tabor et al. . | |
| 3,169,375 | 2/1965 | Velthuis | 60/670 |
| 3,210,553 | 10/1965 | Cummings . | |
| 3,293,851 | 12/1966 | Hulbert et al. | 60/669 |
| 3,303,646 | 2/1967 | Southam | 60/671 X |
| 3,393,515 | 7/1968 | Tabor et al. | 60/669 X |
| 3,457,722 | 7/1969 | Bush . | |
| 3,511,049 | 5/1970 | Norton et al. | 60/671 |
| 3,584,457 | 6/1971 | Davoud . | |
| 3,744,245 | 7/1973 | Kelly . | |
| 3,788,064 | 1/1974 | Hawkins . | |
| 3,795,103 | 3/1974 | Anderson | 60/671 X |
| 3,878,683 | 4/1975 | Imai . | |
| 4,191,021 | 3/1980 | Nakamura et al. . | |
| 4,292,809 | 10/1981 | Bjorklund . | |
| 4,326,301 | 4/1982 | Sato et al. . | |
| 4,423,599 | 1/1984 | Veale | 60/671 X |
| 4,437,308 | 3/1984 | Fischer . | |
| 4,471,621 | 9/1984 | Amir et al. | 60/671 X |

FOREIGN PATENT DOCUMENTS

| | | |
|---|---|---|
| 3032921 | 4/1982 | Fed. Rep. of Germany . |
| 54-114653 | 9/1979 | Japan . |

*Primary Examiner*—Allen M. Ostrager
*Attorney, Agent, or Firm*—Leydig, Voit & Mayer

[57] ABSTRACT

A modular, frame-mounted power unit for converting heat from a low-grade energy source to electric power. Heat from a source is supplied to the power unit in the form of hot fluid circulated through a heat exchanger associated with a boiler. Liquid refrigerant in the boiler is vaporized and passes through the stages of an organic Rankine cycle, the expansion stage being carried out in a rotary, positive displacement expander. The condensing stage is carried out in a condenser associated with a cold heat exchanger which is connected to a supply of cooling fluid through cooling lines. The output shaft of the expander is connected to drive an electric power generator and individual fluid feed pumps for returning liquid refrigerant from the condenser to the boiler and for circulating hot and cold fluids through the hot and cold heat exchangers, respectively. A cylindrical refrigerant boiler and cylindrical condenser pass through and are mounted to two vertical plates, on which are mounted the expander, power generator, fluid circulating pumps, and feed pumps.

14 Claims, 7 Drawing Sheets

POWER UNIT FOR CONVERTING HEAT TO POWER

TECHNICAL FIELD

BACKGROUND ART

In the production of power from a system using a Rankine cycle, if the temperatures on the hot side from which the fluid expansion occurs are high enough, water is generally used as the working fluid in the cycle. Most of the heat sources available on the earth, however, are produced from low-grade energy which cannot efficiently produce a sufficiently high temperature to generate the pressures necessary to produce significant amounts of power in such a system. With water as the working fluid, sufficient pressures are not generated to efficiently operate a power-generating turbine. For this reason, organic fluids, which expand to a much higher pressure than water at the same working temperature, are advantageous for systems using thermodynamic Rankine cycles.

DISCLOSURE OF THE INVENTION

Accordingly, it is a principal object of the present invention to provide an efficient, low cost, easily transportable, simple to operate power generation unit capable of being used anywhere a source of low-grade energy is available as a heat source and employing a Rankine cycle with an organic fluid as the working fluid in the unit.

More specifically, a principal object of this invention is to provide a power unit that is capable of producing output power in a relatively low range, such as 1–5 kilowatts where the output is electrical power, while operating efficiently.

A related object is to provide a modular power unit using a minimum of components that may be easily serviced and are free from troublesome and failure-prone mechanical and electrical complexities.

Another object is to provide a power unit using an organic Rankine cycle, preferably employing a low vapor pressure refrigerant as the working fluid and a constrained rotary vane expander in the expansion stage of the system.

A more specific object is to provide such a power unit using an organic Rankine cycle with a constrained, rotary vane expander as a power output unit, a boiler to produce pressurized vapor for operating the expander, a condenser to condense the exhausted vapor, hot and cold side heat exchange circuits, and simple controls for operating the unit when producing power output from a wide possibility of locally available heat sources.

Another object is to provide such a power unit with a hot side heat exchange circuit which is easily connected to a heat source by conduits and which has fluid pump means driven from the output of the rotary expander for circulating fluid between a heat source and a heat exchanger to provide heat to a boiler containing refrigerant and produce pressurized refrigerant vapor for driving the rotary expander.

Another object is to provide such a system constructed to automatically match the heat transfer from the heat exchangers with the rate of working fluid flow through the expander and thus, the power output from the expander.

BEST MODE FOR CARRYING OUT THE INVENTION

Figure 1:
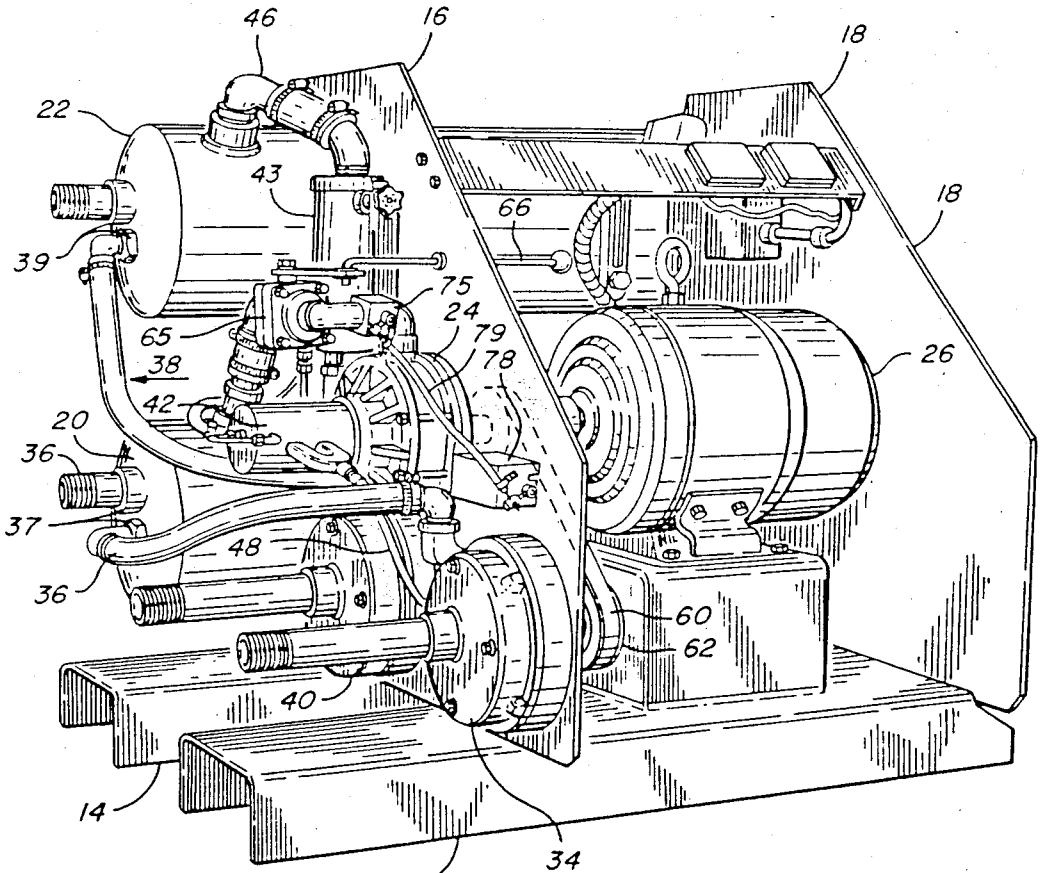
FIG. 1 is perspective view of a transportable frame mounted modular power unit which embodies the present invention.

Turning to FIG. 1, it can be seen that a power unit constructed according to the invention includes a frame comprised of parallel channel members 12, 14 and vertical plates 16, 18, welded or otherwise fixed to the channel members 12, 14, and components mounted on the plates of the frame including an organic boiler 20, a condenser 22, an expander 24, an energy conversion unit 26 driven by the expander 24, a hot side heat exchanger 28 associated with the boiler 20, a cold side heat exchanger 30 associated with the condenser 22, and conduits interconnecting the components. The boiler 20 and condenser 22 are mounted horizontally on the vertical plates 16, 18, each having an end on one side (the left side in FIG. 1) of one of the vertical plates 16. The conduits connecting these components are also primarily located on the left side of the vertical plate 16 and connect to the projecting ends of the boiler and condenser for attachment to the heat exchangers associated therewith and internal chambers included in the refrigerant circuit.

Figure 2A:
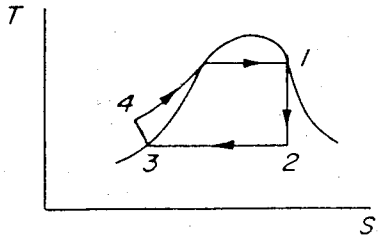
FIG. 2A is a T-s diagram of a basic Rankine cycle.
Figure 2:
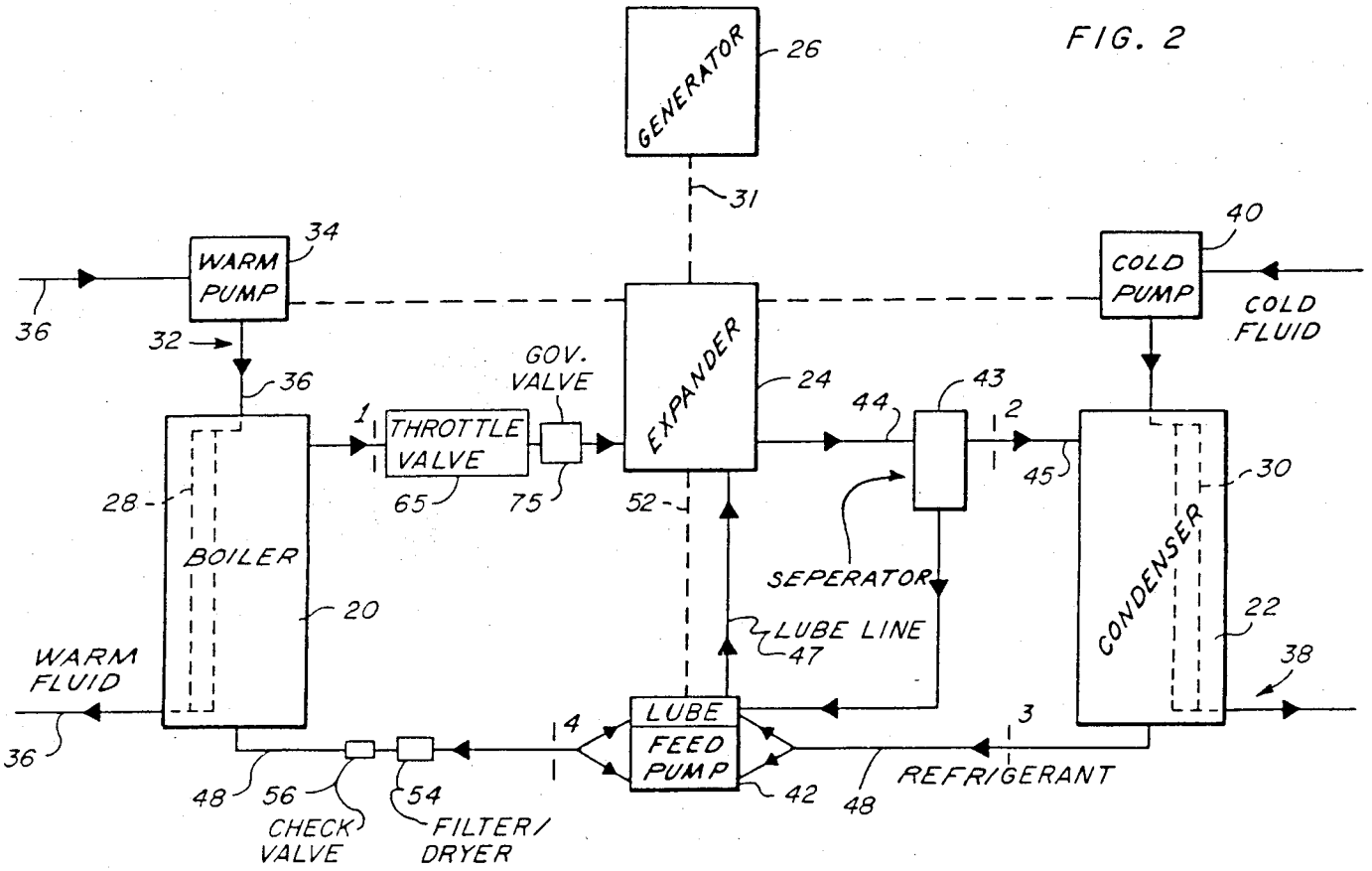
FIG. 2 is a block diagram illustrating system arrangement, fluid flow paths, and the distribution of output torque from the expander.

Referring to FIGS. 2 and 2A, it will be seen that the organic boiler 20, expander 24, and condenser 22 components are constructed and arranged to employ a conventional Rankine cycle as illustrated in FIG. 2A. In carrying out the cycle, a working fluid, preferably a refrigerant such as Freon R11 or R114, is heated in the organic boiler 20 to produce pressurized refrigerant vapor at the temperature $T_1$ and pressure $P_1$ which is supplied through the inlet line 31 to drive the rotary expander 24 in which the vapor is adiabatically expanded to the pressure $P_2$, thereby generating usable power by turning the output shaft of the rotary expander 24. The working fluid vapor exhausted from the rotary expander 24 through the outlet line 33 enters the condenser 22 where it is cooled, condensed and subsequently returned as a liquid to the boiler 20, thereby completing the thermodynamic cycle.

According to this invention, the liquid working fluid is heated and changed in phase to pressurized vapor or gas in the organic boiler 20 due to heat transfer from a medium heated at a heat source and circulated through the hot heat exchanger 28 which is connected in a hot side heat exchange circuit 32. A circulating pump 34 is used to circulate a previously heated heat exchange medium through heat exchanger 28. The heated medium is supplied through conduits 36 readily connected to the inlet and outlet fittings 37 of the hot heat exchanger 28 which is within the outer shell of the boiler 20. Where hot medium is available with sufficient head to circulate through the hot heat exchanger 28, the pump 34 can be eliminated or bypassed to reduce the power otherwise diverted to drive the pump.

A previously cooled heat exchange medium is similarly circulated through the cold heat exchange circuit 38. A second circuit circulating pump 40 circulates the cooling medium through the conduits and inlet and outlet fittings 39 of the cold side heat exchanger 30, which is within the outer shell of the condenser 22, to cool and condense the working fluid vapor in the condenser 22. Where the cooling medium has sufficient head, the pump 40 can be eliminated or bypassed.

Now turning to FIGS. 3–7 and also referring to FIG. 1, while the power produced by the rotation of the expander 24 may be usefully applied through various energy conversion means, such as a take-off gearbox or shaft or pump, it is preferred to utilize an electric generator or alternator 26 driven from the output shaft of the expander 24 and mounted on one of the side plates 16 of the frame. Also mounted through and supported by one of the side plates 16 are the two circulating pumps 34, 40 for the heat exchange circuits 32, 38, these pumps being belt driven from the output shaft of the expander 24. The rotary expander itself is also mounted and supported by one of the side plates 16. In the preferred embodiment of the invention, a dual liquid feed pump 42 is mounted on the outer face of the expander 24. One section of the dual pump 42 is utilized to pump lubricating oil separated from the refrigerant by an oil separator 43 mounted in the flow line between the expander output line 33 and the condenser input line 46 and employed to feed liquid lubricant for mixing with the refrigerant for lubricating the expander. As herein shown the lubricating oil is pumped to the expander rotor through the lube line 47 and mixed with the refrigerant gas within the expander. The second section of the dual pump 42 is utilized to pump liquid refrigerant through the return line 48 from the condenser 22 to the boiler 20.

In carrying out the invention, it is preferred to use a highly efficient, positive displacement expander of the constrained, rotary vane type disclosed in U.S. Pat. Nos. 4,299,097 and 4,410,305. Other positive displacement expanders may be used, such as Wankel or Scroll rotor machines. Such positive displacement machines have constrained rotors so that rotor-to-housing clearances may be maintained, allowing use of low vapor pressure refrigerants, although high vapor pressure refrigerants may be required in some positive displacement machines for efficient operation. Use of the highly efficient constrained rotary vane machine disclosed in the aforesaid patents allows reduction in system complexity because regeneration is not required since it returns a small increase in performance, and the machines are insensitive to the presence of liquid droplets because the expansion process is independent of velocity (momentum) changes. The physical expansion of the vapor is the basis of the energy conversion process. While operation in the superheat region is not believed to be required for satisfactory operation, it may be desired to produce superheated refrigerant vapor to carry out auxiliary functions which enhance system performance.

In the preferred embodiment of this system, radial force may be utilized for the expander vanes in order to ensure, under low operating speeds, continuous vane roller contact with the cam track because centrifugal forces on the vanes are low under under this operating condition. This is obtained in the preferred embodiment by means of a small gas feed line 52 that leads from the expander inlet to the end of the integral pump housing where the gas escapes through the pump shaft into the core of the machine so that its pressure will act on the heels of the vanes, thus helping force them radially outwardly.

An alternative construction involves using vanes so that adequate centrifugal forces required for low speed operation without vane bounce will be generated at low speeds. This may be accomplished by adding mass to the vanes by, for example, solid heavy inserts in the vanes. In addition, an opposing set of two "spring rods" within opposing vane slots can be used to bias the vanes outwardly.

From the outlet of the expander 24, refrigerant vapor is exhausted to the condenser 22. In keeping with the invention, the condenser 22 is located so as to provide positive suction head for the liquid refrigerant from the condenser 22 to the inlet of the liquid feed pump 42. Preferably, the condenser 22 is mounted on the machine frame physically above the boiler 20 so that not only does the liquid flow downhill to the pump inlet but, further, is split into a double flow path as it enters the liquid feed pump 42. This reduces the risk of cavitation in the pump and helps add to the longevity of the system. From the feed pump 42, the liquid passes through a filter/dryer 54. A check valve 56 in the liquid return line to the boiler 20 (downstream of the liquid feed pump 42) takes care of protecting the boiler 20 from draining out when the boiler pressure is above the condenser pressure.

Figure 3:
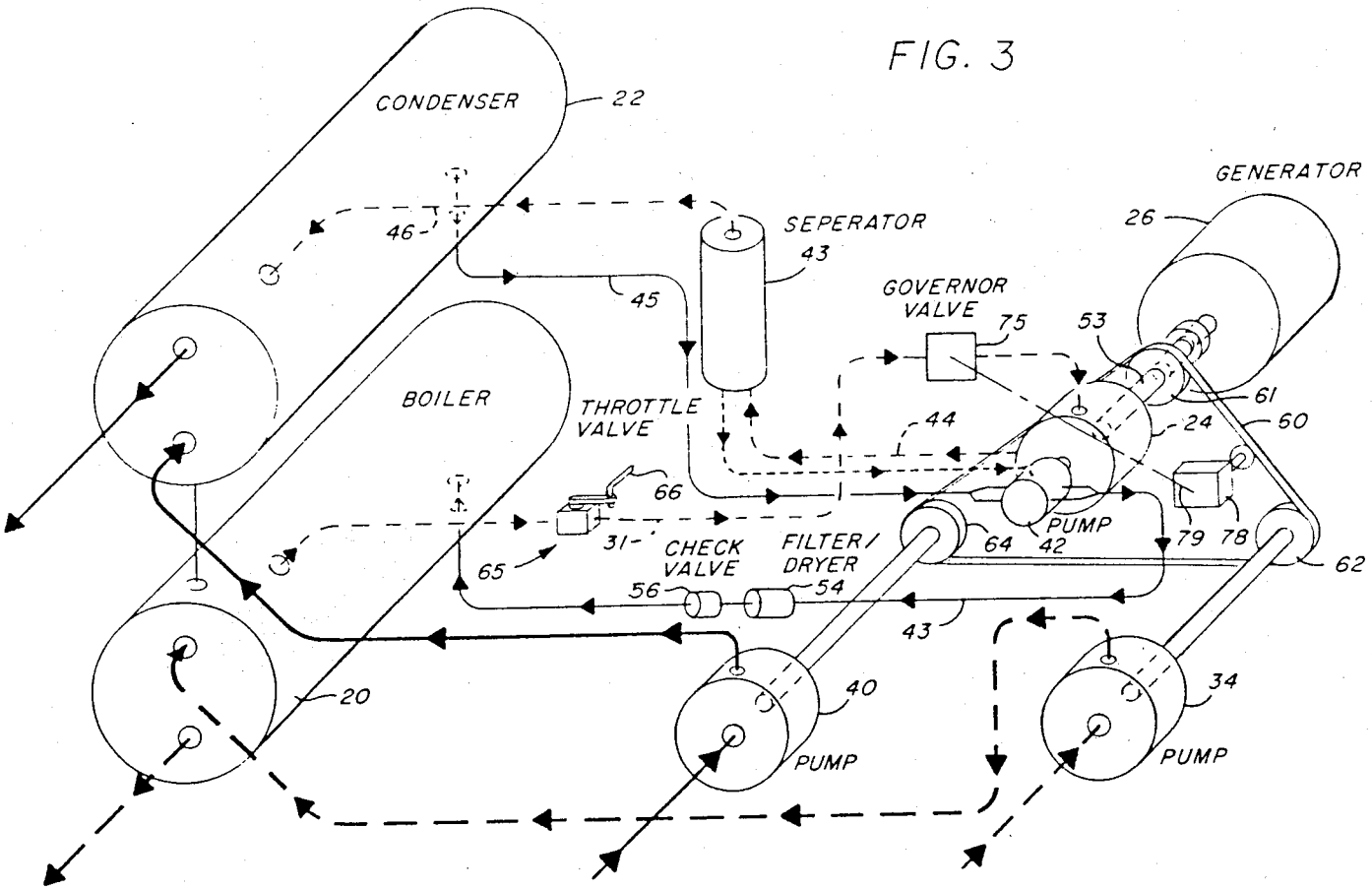
FIG. 3 is a three-dimensional block diagram of the system shown in FIG. 2 but additionally showing system configuration.
Figure 4:
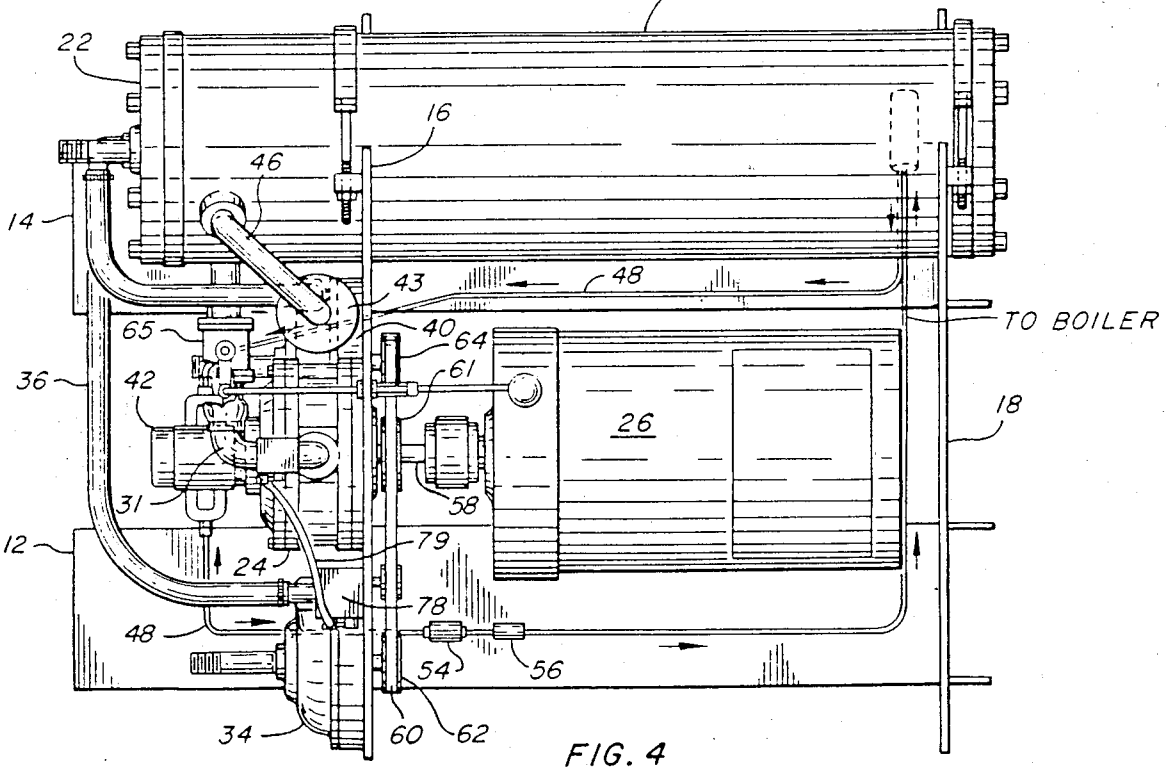
FIG. 4 is a top view of a preferred embodiment of a unit employing the system shown in FIGS. 2 and 3 with parts removed for illustration purposes (such as the throttle valve actuator assembly)
Figure 5:
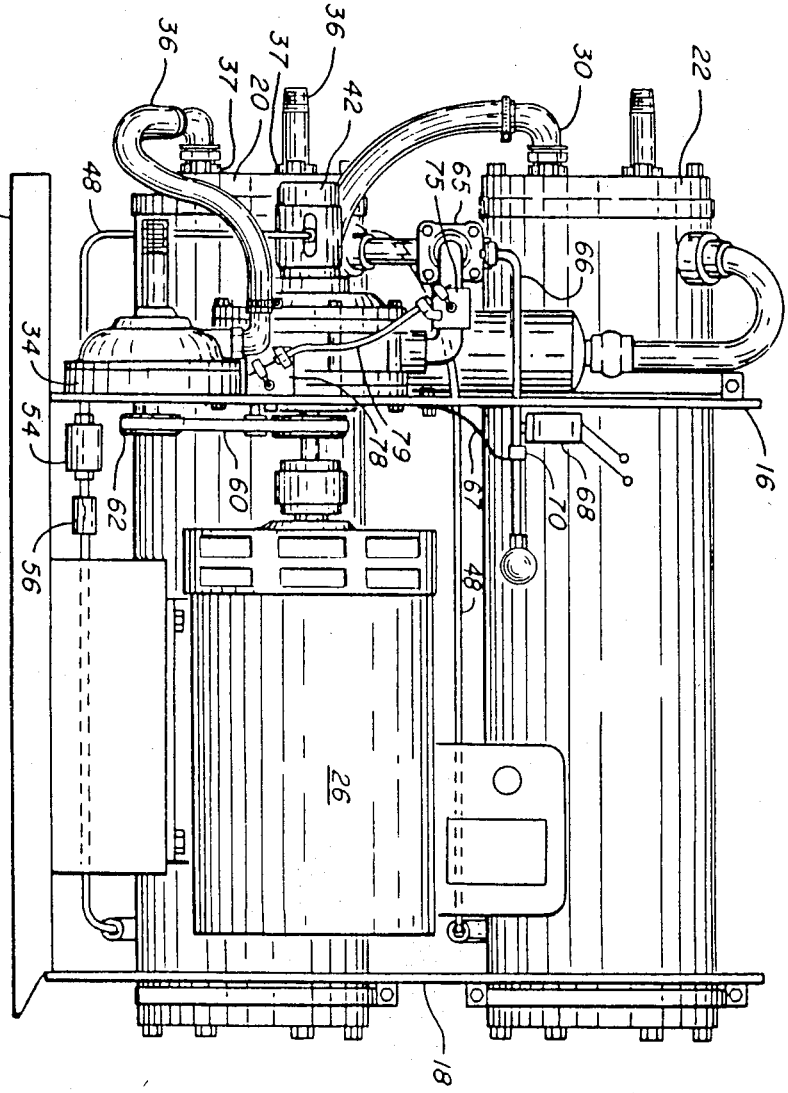
FIG. 5 is a front view of the unit shown in FIG. 4.
Figure 6:
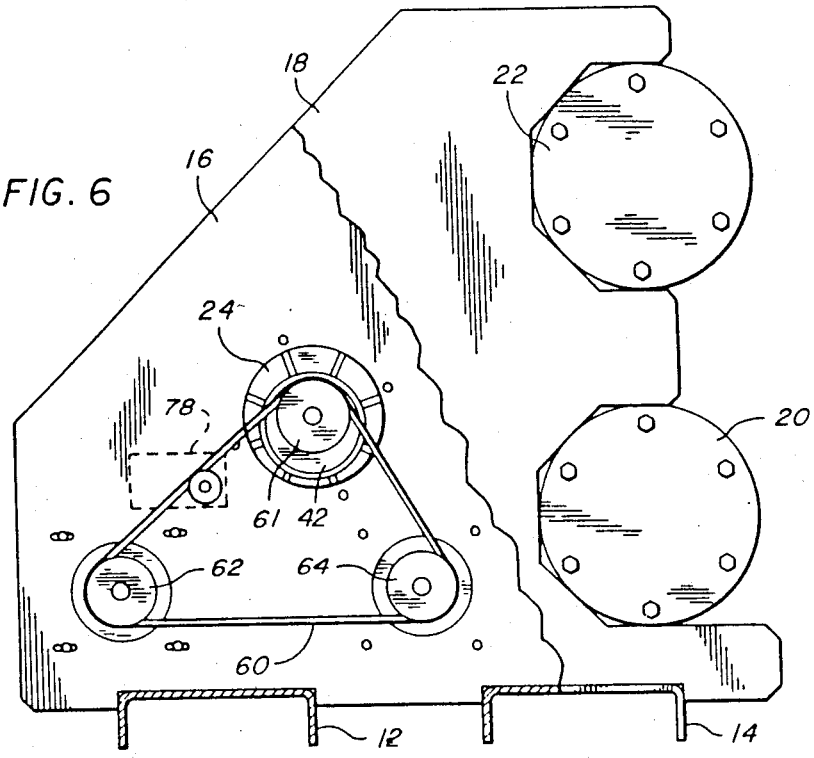
FIG. 6 is a fragmentary end view of the unit showing a portion of the right plate from the right and also showing a portion of the left plate from the right.
Figure 7:
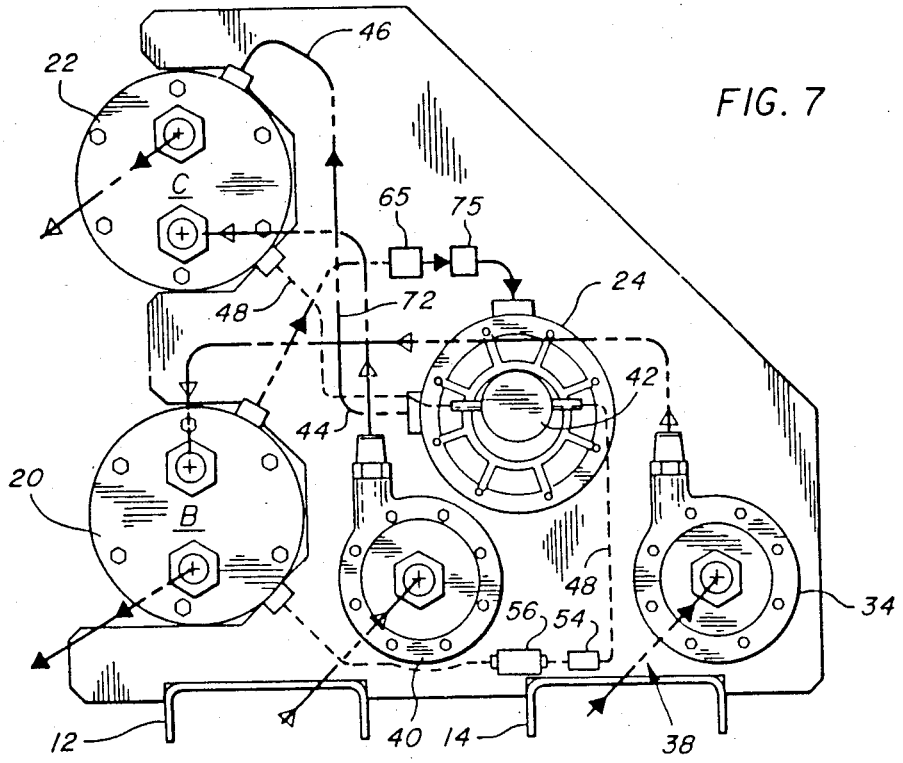
FIG. 7 is a fragmentary end view of the unit showing, in schematic form, the lines between the components.

Further in keeping with the invention, referring to FIGS. 3, 4 and 5, the rotary expander 24 is mounted on the left side of the vertical plate 16 and the output shaft 58 of the expander 24 extends horizontally on the opposite (right-hand) side of the plate 16 where it is connected to different components mounted on the machine frame, including the rotor shaft of the generator 26, the dual liquid feed pump 42, and the two feed pumps 34, 40 of the heat exchange circuits. In the preferred embodiment of the invention, the shaft of the generator 26 and the shafts of the dual feed pump 42 are coupled to flexible coupling on the expander output shaft 58. The two fluid pumps 34, 40 of the heat exchange circuits have horizontal shafts which extend on the right-hand side of the plate 16, and the parallel drive shafts of the generator 26 and pumps 34, 40 are belt driven, preferably by means of a timing or cog belt 60. This timing belt 60 is trained around a pulley 61 on the expander output shaft 58 and subsequently around pulleys 62, 64 which drive shafts of the the fluid pumps 34, 40. This direct-drive method of operating the pumps of the system provides maximum efficiency due to virtually direct mechanical energy transfer and also provides means for operating them in timed relationship with the output speed of the expander and variations in power output. By this means, the flow rate of the fluids through the hot and cold heat exchange circuits 32, 38 and, therefore, the heat transfer to the boiler 20 and from the condenser 22 is automatically matched with the rate of refrigerant gas flow through the expander 24 and thus, the power output of the expander.

The direct-drive method provides a simple means for matching the characteristic performance curve of a centrifugal pump, a type of pump preferably used for the fluid pumps of the heat exchange circuits (flow rate versus head pressure) with the characteristic performance of the boiler and condenser (heat transfer rate versus flow rate). This matching may be achieved through changes in the pitch diameters of the sheaves of the belt drive or even the impeller diameter of the pump.

Similarly, the liquid feed pump flow rate varies essentially directly with shaft speed, thus providing an automatic following of vapor mass flow rates through the expander by the mass flow return rates of the liquid through the liquid feed pump. This ensures that the respective liquid levels in the condenser and boiler remain at essentially optimum values, with the condenser nearly empty and the boiler nearly full, for maximum condensation and maximum boiling.

Figure 8:
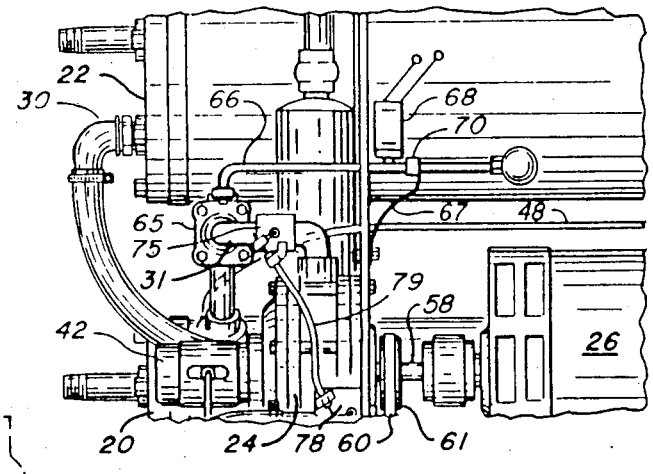
FIG. 8 is an enlarged fragmentary view showing the valve actuating assembly of the control system.
Figure 9:
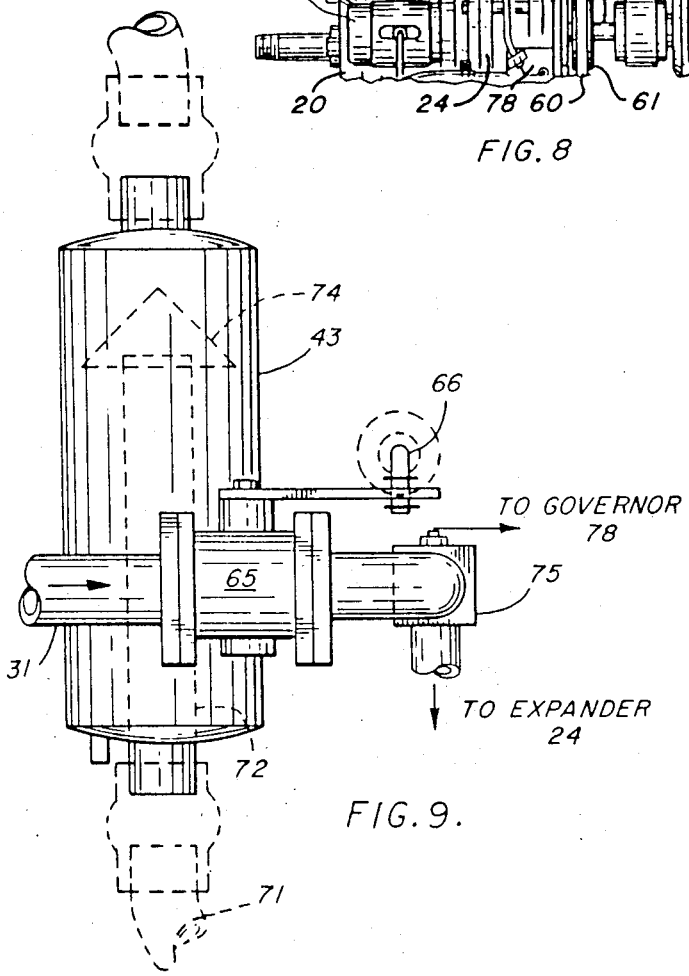
FIG. 9 is an enlarged view of the control system and lubricant separator.

Referring now to FIGS. 1, 8 and 9, in carrying out the invention means are provided for controlling the output speed of the shaft 58 of the expander 24 for safe, efficient operation of the system. When adequate boiler pressure is reached for start-up, the throttle valve, herein shown as a ball valve in the expander inlet line 31, is opened by manually pushing a throttle rod 66 to the right (FIGS. 1 and 8). During this procedure, the throttle return spring 67 (FIG. 8) is cocked. At the same time, as the maximum open throttle condition is met, the stem of an underspeed/overspeed solenoid 68 engages a latch 70 on the throttle push rod 66, thus holding it in. However, by operating the solenoid responsive to output speed, at a given high speed the solenoid 68 retracts and the mechanical energy stored in the spring (as a result of manually opening the throttle) will be released, causing a very rapid movement to the left of the throttle rod 66 and closure of the throttle control valve 65, thus shutting the machine down before it would have a chance to damage itself. The purpose of the return spring 67 is to provide a method of very rapidly closing the loop throttling valve in the event that the boiler pressure exceeds a defined limit. The throttle valve 65 must seal completely when the unit is not operating so that the gas does not migrate from the boiler through the expander over to the cooler condenser over time. In the absence of manually stressing the throttle return spring 67, the throttle valve 65 is automatically kept shut and the ball valve provides the complete seal.

If the solenoid stem remains retracted at startup, the only way the throttle valve 65 will stay open is by manually holding it open because the spring will not be restrained by the solenoid/latch arrangement. This, therefore, provides an underspeed control as well as an overspeed control. An equivalent bellows construction may be used as an alternative. The underspeed control is important because it prevents the machine from operating at low rpm which may cause the vanes to bounce harmfully within the expander. Slow speed operation of any appreciable duration would deplete the liquid in the boiler because the liquid pump, operating at very low speeds, might not be capable of pumping liquid.

In addition to the throttle valve overspeed-underspeed control system, a governor-operated valve 75 is provided in the expander inlet line 31 between the ball throttle valve 65 and the expander to govern the rotary speed of the expander 24. Preferably, the governor-operated valve 75 is a butterfly valve which requires low force to operate, as compared with the ball throttle valve 65, and is capable of automatically keeping the output speed in a range, for example, of about 1,800 rpm, when operated by a governor. A governor 78, preferably a conventional mechanical governor, is mounted on the vertical plate 16 and connected by a linkage 79 to control the position of the butterly valve 75. The governor 78 is driven by a pulley or the like engaging the belt 60 and thus is driven according to the speed of the output shaft 58 of the rotary expander 24.

Referring to FIG. 9, the system of this invention has liquid lubricant injected into the core of the expander. Expanded gas exits the expander 24 toward the condenser 22 through the expander discharge bend 71 and begins traveling vertically through a standup pipe 72 of the lubricant/vapor separator 43. As the lubricant, which is entrained in the discharging vapor, impacts the separator element 74, it agglomerates on the underside of the separator element surface and falls into the main body of the separator where the lubricant flows downhill to the lubricant section of the integral dual pump 42 from which is it pumped back into the expander core.

Other means may be used for separating lubricant from refrigerant or the power unit may have the refrigerant and liquid lubricant mixed throughout the entire cycle, thus eliminating the lubricant separator and system of injecting lubricant into the core of the expander.

What is claimed:

1. A modular power unit for converting heat to electric power comprising:

a machine frame including two parallel vertical plates, a horizontal cylindrical refrigerant boiler passing through the plane of each of said plates,with its axis normal to each of said planes and mounted to each of said plates;

a horizontal cylindrical condenser passing through the plane of each of said plates with its axis normal to each of said planes and mounted to each of said plates above said boiler;

a rotary, positive displacement expander mounted on one side of a first of said plates and having an output shaft extending horizontally on the opposite side of said first plate;

a refrigerant circuit connecting said boiler and condenser to said expander providing means for circulating refrigerant in said boiler through the stages of a Rankin cycle including expansion of pressurized refrigerant vapor from said boiler through said expander to said condenser, condensing refrigerant vapor to liquid in said condenser, and returning condensed liquid refrigerant from said condenser to said boiler;

an electric power generator mounted on said frame adjacent said opposite side of said first plate;

a hot fluid heat exchange circuit means for connecting said boiler with a heat source including a heat exchanger associated with said boiler;

a cold fluid heat exchange circuit means for connecting said condenser with a cold source including a heat exchanger associated with said condenser;

fluid circulating pump means for each of said fluid heat exchange circuits mounted on said first plate having connections on said one side of said first plate and drive shafts extending horizontally and parallel to said output shaft on said opposite side of said first plate;

a refrigerant feed pump means to assist the transport of liquid refrigerant from the condenser to the boiler; and drive means on said opposite side of said vertical plate connecting said output shaft of said expander to drive said parallel drive shafts of said fluid circulating pump means.

2. A modular power unit for converting heat to electric power as in claim 1, further comprising:

means for controlling the rate of flow of refrigerant vapor from the boiler to the expander so that it matches the rate of flow of fluids through the heat exchange circuits.

3. A power unit according to claim 2 wherein said drive means includes a drive belt.

4. A power unit as claimed in claim 1 further comprising an overspeed/underspeed control mechanism to control the speed of the output shaft of said expander.

5. A power unit as claimed in claim 1 including wherein said drive means includes timing belt means connecting said output shaft of said expander to drive said fluid circulating pump means and said refrigerant feed pump means in timed relationship with the output speed of said output shaft and variations in power output.

6. A power unit as claimed in claim 5 wherein said liquid circulating pumps and said rotary vane expander are rigidly face-mounted to maintain alignment of the fluid circulating pumps and the rotary vane expander.

7. A power unit as claimed in claim 2 wherein lubricant is injected into the core of the expander to mix with refrigerant vapor therein.

8. A power unit as claimed in claim 7 wherein lubricant is separated from the refrigerant vapor in a lubricant separator, said separator being disposed between said expander and said condenser.

9. A power unit according to claim 1 wherein said drive means includes cooperating gears.

10. A power unit according to claim 1 wherein said electric power generator has an input shaft parallel to said output shaft.

11. A power unit according to claim 1 wherein said electric power generator has an input shaft coupled directly to said output shaft.

12. A power unit according to claim 1 wherein said expander is a Scroll rotor machine.

13. A power unit according to claim 1 wherein said expander is a Wankel rotor machine.

14. A power unit according to claim 1 wherein said expander comprises in combination a housing defining a chamber having opposed parallel end walls and a curved smoothly continuous outer wall centered about a chamber axis, a rotor of cylindrical shape having a plurality of equally spaced radial grooves formed therein and having a shaft for supporting the same for rotation in the housing, vanes profiled to fit the chamber and radially slideable in the grooves to define and close compartments between them, each vane having a pair of axially extending stub shafts having rollers respectively mounted thereon, roller tracks formed in the end walls of the chamber for accommodating the rollers and for guiding the vanes so that the outer edges of the vanes follow in closely spaced proximity the outer wall of the chamber means defining an inlet port on an inlet side of the chamber and outlet port on the outlet side of the chamber, the rotary having its axis laterally offset from the chamber axis.

* * * * *